US006085440A

United States Patent [19]

Getler

[11] Patent Number: 6,085,440

[45] Date of Patent: Jul. 11, 2000

[54] PROCESS AND AN APPARATUS FOR PRODUCING A POWDERED PRODUCT BY SPIN FLASH DRYING

[75] Inventor: Jens Getler, Bronshoj, Denmark

[73] Assignee: APV Anhydro AS, Soborg, Denmark

[21] Appl. No.: 09/068,837

[22] PCT Filed: Nov. 21, 1996

[86] PCT No.: PCT/DK96/00480

§ 371 Date: Jul. 15, 1998

§ 102(e) Date: Jul. 15, 1998

[87] PCT Pub. No.: WO97/19307

PCT Pub. Date: May 29, 1997

[30] Foreign Application Priority Data

Nov. 21, 1995 [DK] Denmark ..... 1308/95

[51] Int. Cl.[7] ..... F26B 5/08

[52] U.S. Cl. ..... 34/314; 34/326; 34/333; 34/363; 34/371; 34/378; 34/579; 34/135; 34/138; 34/169; 34/86

[58] Field of Search ..... 34/314, 326, 332, 34/333, 363, 370, 371, 378, 423, 425, 579, 583, 86, 135, 138, 168, 169, 218, 219, 221; 209/140, 143; 210/771, 781, 787; 426/285, 312, 317; 159/4.2, 4.08, 48.1

[56] References Cited

U.S. PATENT DOCUMENTS

| | | | |
|---|---|---|---|
| 3,228,116 | 1/1966 | Swanson et al. | 34/579 |
| 3,861,059 | 1/1975 | Lindemann et al. . | |
| 4,055,903 | 11/1977 | Hansen et al. . | |
| 4,220,193 | 9/1980 | Klaren | 34/579 X |
| 5,100,509 | 3/1992 | Pisecky et al. | 159/4.2 |
| 5,276,977 | 1/1994 | Cysewski | 34/371 |
| 5,291,668 | 3/1994 | Becker et al. . | |
| 5,526,938 | 6/1996 | Kraft et al. | 34/371 X |
| 5,773,061 | 6/1998 | Getler et al. | 34/378 X |

FOREIGN PATENT DOCUMENTS

| | | |
|---|---|---|
| 0141403 | 5/1985 | European Pat. Off. . |

*Primary Examiner*—Stephen Gravini
*Attorney, Agent, or Firm*—Birch, Stewart, Kolasch & Birch, LLP

[57] ABSTRACT

A process and an apparatus for drying of a material in the form of a paste or a filter cake in a spin flash dryer. Particles are separated by a classifier (6) in the chamber (1) in such a way that oversize fraction is withheld in the chamber (1) and the desired fraction is removed (3, 9). A possible undesired undersize fraction is strained off and recycled (4, 10, 11) externally back to the dryer chamber (1). The spent drying gas is recycled to the dryer chamber (1). In either, the energy in the spent drying gas may be made use of in a heat exchanger and there is no or only little emission to the environment. Products preferably dried according to the invention are fruit and beet pulps, destillers residues, pesticides, pigments, dyes, ceramics, active coal, sludge and zeolites.

21 Claims, 1 Drawing Sheet

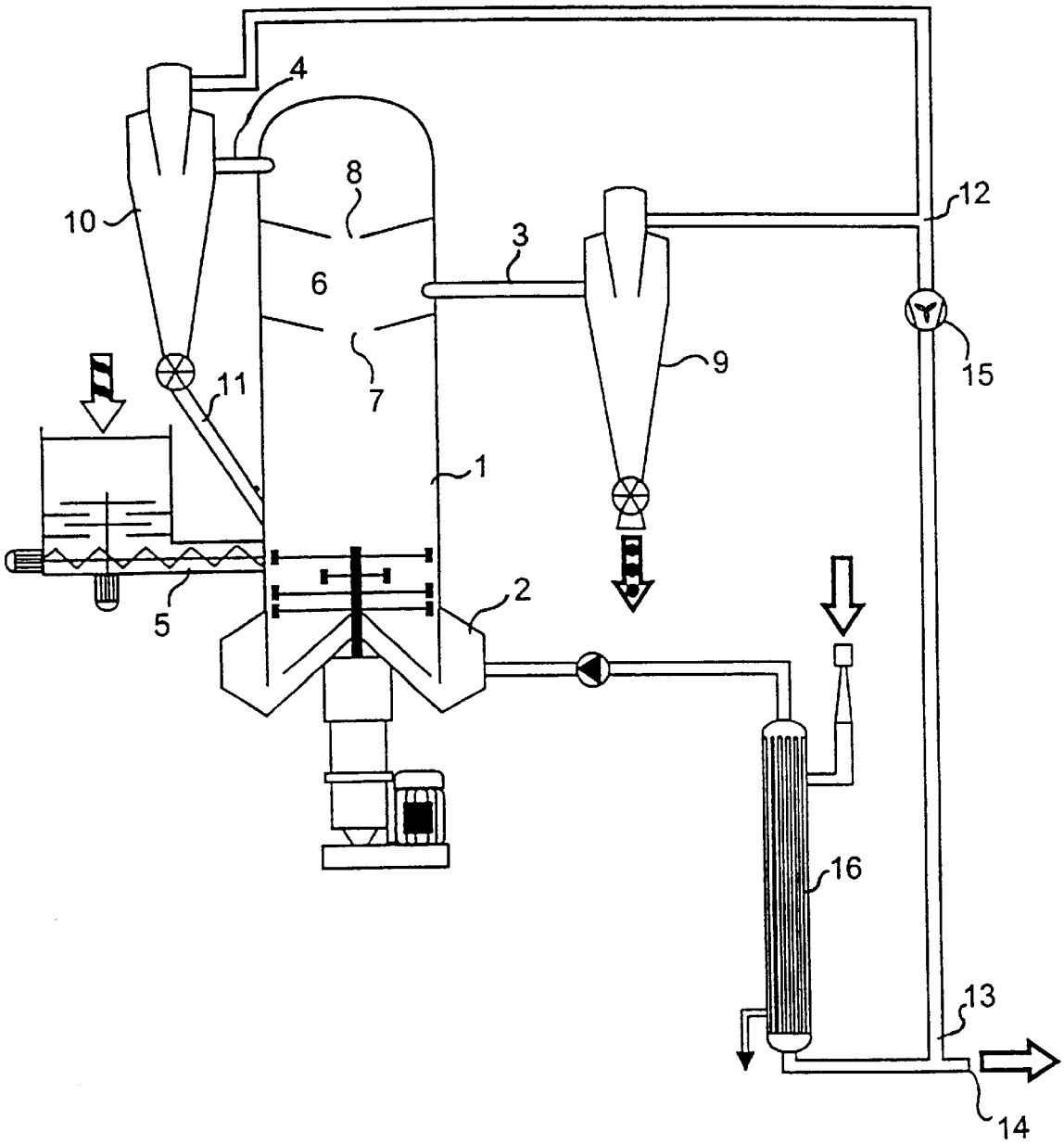
4
8
10
3
12
6
9
15
11
7
1
5
2
16
13
14

PROCESS AND AN APPARATUS FOR PRODUCING A POWDERED PRODUCT BY SPIN FLASH DRYING

This application is the national phase under 35 U.S.C. §371 of prior PCT International Application No. PCT/DK96/00480 which has an International filing date of Nov. 21, 1996 which designated the United States of America, the entire contents of which are hereby incorporated by reference.

The present invention relates to a process and an apparatus for producing a powder by spin flash drying.

The invention specifically relates to a process and an apparatus for drying of a material in the form of a paste or a filter cake, with a vertical, cylindrical dryer chamber having a rotating coaxially placed stirrer, with a variable speed drive screw feeder and with apertures for supply of hot drying gas and for removal of the spent drying gas and removal of the dried material.

Products preferably dried according to the invention are fruit and beet pulps, distillers residues, pesticides, pigments, dyes, ceramics, active coal, sludge and zeolites.

It is well known, e.g. from EP 0 141 403 to dry materials in the form of a paste or filter cake to obtain a powder.

In this apparatus the produced powder particles' size are all under a given cut size and the residual drying gas is furthermore emitted to the environment.

In U.S. Pat. No. 5,291,668 is described a spin flash type of system for drying of sludge in water vapour. The system uses a louver separator for production of fine particles; the system requires steam recompression for energy utilization.

It is the object of the present invention to provide a process and an apparatus of the spin flash dryer type, which is particular suitable for drying of pastes and filter cakes into a powder with a desired mean particle size and a narrow particle size distribution. Low consumption of energy and little or no emission to the environment should secondarily be obtained.

By the novel means according to the invention presented in claim 1 for the process and claim 6 for the apparatus, particles are separated by a classifier in the chamber in such a way that oversize fraction is withheld in the chamber and the desired fraction is removed. A possible undesired undersize fraction is strained off and recycled externally back to the dryer chamber.

The cut sizes of the classifier is adjustable.

The spent drying gas is recycled to the air distributor of the dryer chamber and is reheated by indirect or by direct heat. With indirect reheat, the composition of the drying gas will be water vapour; with direct reheat it will be air with a high moisture content. In either, the energy in the spent drying gas may be made use of in a heat exchanger and there is no or only little emission to the environment.

By this process it is possible to obtain a powder with a desired mean particle size and a narrow particle size distribution by spin flash drying, with a low consumption of energy and with little or no emission to the environment.

During operation of the spin flash dryer the drying gas will create a high velocity, whirling fluidized bed of drying particles which moves up through the chamber during the drying process.

Heavy, still wet lumps are forced towards the chamber walls. Disintegration, attrition and drying cause particles to become smaller and lighter and, as a consequence, a balanced fluid bed is created in which smaller particles move towards the axis of the dryer chamber.

By selecting operating conditions, a state of equilibrium is obtained in which the feed rate of moist material is in balance with the corresponding drying capacity (a principle, known to a person skilled in the art of drying) and with the discharge rate of the dried product. It is a surprising effect of the spin flash dryer, that the particles remain in the drying zone until they obtain the desired particle size.

By the invention it is possible, within certain limits, to remove particles under a given particle size (which equals the desired maximum) by selecting the diameter of the orifice of the first classifier means in the upper part of the dryer chamber, above which drying gas with entrained particles is removed from the dryer.

Undesired undersize particles are removed above the second classifier means having a second orifice with an annular opening, and recycled to the lower part of the dryer chamber where they will agglomerate with wet product and form larger particles. Produced powders, leaving the dryer between the orifices are hence with a desired mean particle size and a narrow particle size distribution.

The process control is as follows:

Adjusting the first orifice of the first classifier means to obtain an over cut size of particles, adjusting the second orifice of the second classifier means to obtain an under cut size of particles, withdrawing a stream of spent drying gas with particles from the dryer chamber between first and second classifier means to obtain a powder of desired particle size and preferably within a predetermined particle size interval, withdrawing a stream of spent drying gas with under size particles passing the second orifice and separating and recycling the undersize particles to the dryer chamber.

Furthermore secondly collecting exit gases, splitting the total exit gas into a stream which is reheated indirectly or directly and recycled into the air distributor of the dryer chamber and a stream of excess spent drying gas which is utilized in a heat exchanger The total pressure in the dryer chamber may be, but is not restricted to, atmospheric pressure.

According to a preferred embodiment the recycled drying gas is reheated by indirect heating e.g. in a steam heated heat exchanger.

This embodiment is advantageous because there is no emission of drying gas to the environment. The excess drying gas consists of pure water vapour whose entire content of energy may be extracted in a heat exchanger and utilized elsewhere. Further, volatile components (flavors, odors and other low-boiling components) may be condensed and separated from the condensed water.

According to a another preferred embodiment the recycled drying gas is reheated by direct heating e.g. by gas.

By these preferred methods of reheating, the drying gas contains little or no air or oxygen.

The main features of this principle are:

drying rate is increased because heat transfer coefficients are higher, which gives increased capacity in a given dryer volume, latent heat for water evaporation may be recovered drying takes place in reduced amount or absence of oxygen which reduces risk of explosion and fire hazard reduced or no emission to the environment the quality of some products esp. organic materials is improved According to a preferred embodiment when recycled gas is reheated by direct gas heating, the excess of drying gas is controlled in such a way that the moisture content in the drying gas is 0.4 kg water pr kg dry drying air or higher, preferably 0.6 kg/kg or higher, the upper limits being determined by the characteristics of the gas burner.

The invention is further described with reference to the drawing.

In the drawing 1 represents a spin flash dryer chamber provided with a drying gas inlet 2
a first drying gas outlet 3
a second drying gas outlet 4
a variable speed screw feeder 5
a classifier 6
a first annular orifice 7
a second annular orifice 8
a separator for desired particles 9
a separator for undersize particles 10
a conduit for recycling of undersize particles 11
means to collect exit drying gases 12
means to separate drying gas 13
conduit to a cooler (not shown) 14
a fan 15
a reheater (the figure shows an indirect heater; a direct heater is
optional) 16

The process is carried out in an apparatus according to the invention for producing a powder with a desired mean particle size and a narrow particle size distribution, with a low consumption of energy and with little or no emission to the environment, comprising a spin flash dryer with a vertical, cylindrical dryer chamber 1, having a rotating, coaxially placed stirrer, with a variable speed drive screw feeder 5 and with apertures for supply of hot drying gas 2 and for the removal of the spent drying gas and removal of the dried material, a classifier 6 in the upper part of the dryer chamber, means for separating suspended desired particles from drying gas 9, means for separating 10 and recycling 11 undersize particles to the dryer chamber, means 12 for collecting streams of exit drying gas, means 13 for separating drying gas into an excess stream 14, which is led to a cooler and a stream which is recycled as drying gas to the dryer chamber and means to reheat the recycled drying gas.

According to the preferred embodiment the classifing system 6 consists of a first classifier means with a central annular orifice 7 and of a second classifier means with a central annular orifice 8. Particles with the desired mean particle size and a narrow particle size distribution is extracted between the two orifices 7 and 8. Undersize particles pass through the upper orifice 8 and are recycled to the chamber 1.

According to a further preferred embodiment the distance between the annular orifices 7, 8 is 0.1 to 1 times, preferably 0.2 to 0.5 times the diameter of the dryer chamber. The diameter of the lower annular orifice is 0.1 to 0.95, times the diameter of the dryer chamber 1, preferably 0.5 to 0.95, the diameter of the upper annular orifice is 0.05 to 0.9, preferably 0.45 to 0.9 times the diameter of the dryer chamber 1.

According to a further preferred embodiment the orifices 7, 8 of the classifiers are adjustable.

There is no known theoretical model of determining the relation between classifier orifices and particle cut size for a given product, and annular openings to achieve desired particle cut sizes must therefore inevitably be determined by empirical methods. Orifices may be changed by loose inserts or—continuously and during operation—by iris diaphragm valves (e.g. as manufactured by Mucon).

What is claimed is:

1. A process for producing a powder by spin flash drying, thereby drying a paste or a filter cake comprising the steps of, feeding the material to be dried to a dryer chamber (1), contacting said material with a stream of drying gas to obtain dry particles, adjusting the amount of introduced material with the amount and drying capacity of introduced drying gas thereby controlling to a desired moisture content and size of the particles leaving the dryer chamber (1), subjecting said particles to a size classification into at least two fractions in a classifier (6), which first fraction comprises particles with the predetermined particle size distribution, which is withdrawn as product, suspended in a first exit gas stream, and which second undersize fraction is withdrawn from the classifier (6) as an entrained suspension in a second exit gas stream and is returned to the dryer chamber (1) as solid particles.

2. The process according to claim 1, comprising the step of collecting the gas of the first and second exit gas streams from the classifier (6) after separation of the particles from the gas streams, and returning the collected gas as drying gas to the dryer chamber (1).

3. The process according to claim 1, wherein the recycled drying gas is reheated by indirect heating.

4. The process according to claim 1, wherein the recycled drying gas is reheated by direct heating.

5. The process according to claims 1 and 4, wherein the excess of drying gas is controlled in such a way that the moisture content in the drying gas is 0.4 kg water pr kg dry drying air or higher.

6. An apparatus comprising, a spin flash dryer with a vertical, cylindrical dryer chamber (1), having a rotating coaxial placed stirrer, with a variable speed drive screw feeder (5) and with apertures (2) for supply of hot drying gas and for the removal of the spent drying gas and removal of the dried material, a first classifier means (7) in the upper part of the dryer chamber (1), a second classifier means (8) in the upper part of the dryer chamber (1), means (9) for separating suspended desired particles from drying gas, means (10, 11) for separating and recycling undersize particles to the dryer chamber (1).

7. Apparatus according to claim 6, wherein each of the first and second classifier means comprises a central annular orifice (7, 8).

8. Apparatus according to claim 6, wherein the distance between the annular orifices of the first and the second classifier means (7,8) is 0.1 to 1 times, the diameter of the dryer chamber (1).

9. Apparatus according to claim 6, wherein the diameter of the lower annular orifice (7) is 0.1 to 0.95 times the diameter of the dryer chamber (1), and the diameter of the upper annular orifice (8) is 0.05 to 0.9 times the diameter of the dryer chamber (1).

10. Apparatus according to claim 6, wherein the orifices of the classifier means (7, 8) are adjustable.

11. Apparatus according to claim 6, comprising means (12)for collecting streams of exit drying gas, means (13) for separating drying gas into an excess stream, which is led to a cooler (14) and a stream which is recycled as drying gas to the dryer chamber (1).

12. Apparatus according to claim 11, wherein means (16) to reheat the recycled drying gas are provided.

13. A process according to claim 2, wherein the excess of drying gas is controlled in such a way that the moisture content in the drying gas is 0.4 kg water pr kg dry drying air or higher.

14. A process according to claim 3, wherein the excess of drying gas is controlled in such a way that the moisture content in the drying gas is 0.4 kg water pr kg dry drying air or higher.

15. A process according to claim 4, wherein the excess of drying gas is controlled in such a way that the moisture content in the drying gas is 0.4 kg water pr kg dry drying air or higher.

16. The process according to claim 5, wherein the moisture content in the drying gas is 0.6 kg/kg dry drying air or higher.

17. Apparatus according to claim 8, wherein the distance between the annular orifices of the first and second classifier means (7,8) is 0.2 to 0.5 times the diameter of the dryer chamber (1).

18. Apparatus according to claim 9, wherein the diameter of the lower annular orifice (7) is 0.5 to 0.95 times the diameter of the dryer chamber (1), and upper annular orifice (8) is 0.45 to 0.9 times the diameter of the dryer chamber (1).

19. A process according to claim 2, wherein the excess of drying gas is controlled in such a way that the moisture content in the drying gas is 0.6 kg water pr kg dry drying air or higher.

20. A process according to claim 3, wherein the excess of drying gas is controlled in such a way that the moisture content in the drying gas is 0.6 kg water pr kg dry drying air or higher.

21. A process according to claim 4, wherein the excess of drying gas is controlled in such a way that the moisture content in the drying gas is 0.6 kg water pr kg dry drying air or higher.

* * * * *